US008038130B2

(12) United States Patent
Weinhold et al.

(10) Patent No.: US 8,038,130 B2
(45) Date of Patent: Oct. 18, 2011

(54) TWO-STROKE ENGINE AND METHOD FOR OPERATING A TWO-STROKE ENGINE

(75) Inventors: Peter Weinhold, Erlensee (DE); Peter Wintrich, Roedermark (DE)

(73) Assignee: 3W-Modellmotoren GmbH, Roedermark (DE)

( * ) Notice: Subject to any disclaimer, the term of this patent is extended or adjusted under 35 U.S.C. 154(b) by 632 days.

(21) Appl. No.: 12/190,948

(22) Filed: Aug. 13, 2008

(65) Prior Publication Data

US 2010/0038805 A1 Feb. 18, 2010

(51) Int. Cl.
*F02M 15/04* (2006.01)
*F02M 17/34* (2006.01)
*F02M 35/10* (2006.01)

(52) U.S. Cl. ..... 261/142; 123/590; 138/44; 261/144; 261/DIG. 12

(58) Field of Classification Search ..... 261/64.1, 261/78.1, 79.1, 142, 144, DIG. 1, DIG. 12, 261/DIG. 55, DIG. 56; 123/52.5, 198 R, 123/198 E, 590; 138/44, 46; 251/121
See application file for complete search history.

(56) References Cited

U.S. PATENT DOCUMENTS

| | | | | | |
|---|---|---|---|---|---|
| 860,848 | A | * | 7/1907 | Bowers | 261/57 |
| 1,052,051 | A | * | 2/1913 | Grimes | 261/53 |
| 1,366,530 | A | | 1/1921 | Gage | |
| 1,733,668 | A | * | 10/1929 | Leibing | 261/41.2 |
| 2,007,337 | A | * | 7/1935 | Mallory | 261/61 |
| 2,078,029 | A | * | 4/1937 | Schorsch | 261/51 |
| 3,054,604 | A | | 9/1962 | Reynolds et al. | |
| 3,414,242 | A | * | 12/1968 | Bouteleux | 261/18.3 |
| 3,817,227 | A | | 6/1974 | Onishi | |
| 3,952,776 | A | * | 4/1976 | Eversole et al. | 138/39 |
| 4,228,770 | A | * | 10/1980 | Boyesen | 123/73 V |
| 4,250,856 | A | * | 2/1981 | Abbey | 123/439 |
| 4,295,458 | A | * | 10/1981 | Pellerin | 48/189.4 |
| 4,308,845 | A | * | 1/1982 | Sarto | 123/549 |
| 4,387,685 | A | * | 6/1983 | Abbey | 123/439 |
| 4,474,145 | A | * | 10/1984 | Boyesen | 123/73 PP |
| 4,492,212 | A | * | 1/1985 | Dooley | 123/590 |
| 4,673,536 | A | * | 6/1987 | Morris | 261/78.1 |
| 4,690,107 | A | * | 9/1987 | Emler et al. | 123/65 V |
| 4,788,951 | A | | 12/1988 | Nagashima | |
| 4,836,151 | A | * | 6/1989 | Litjens et al. | 123/65 V |
| 5,097,814 | A | | 3/1992 | Smith | |
| 5,855,192 | A | | 1/1999 | McCowan et al. | |
| 6,120,007 | A | * | 9/2000 | Grant | 261/23.2 |
| 6,374,790 | B1 | | 4/2002 | Vassallo et al. | |
| 2008/0178854 | A1 | * | 7/2008 | Russell | 123/590 |

FOREIGN PATENT DOCUMENTS

| | | | | |
|---|---|---|---|---|
| DE | 644 933 C | | 5/1937 | |
| DE | 37 30 090 A 1 | | 3/1988 | |
| EP | 416203 A1 | * | 3/1991 | 261/DIG. 12 |

* cited by examiner

*Primary Examiner* — Richard L Chiesa
(74) *Attorney, Agent, or Firm* — Leydig, Voit & Mayer, Ltd.

(57) ABSTRACT

A two-stroke engine with external fuel mixture generation in a carburetor. The engine including a suction funnel having an interior disposed upstream of the carburetor. The engine further includes a tapered insert having a narrow end and a wide end disposed in an area of an inlet port of the suction funnel. The insert at least partially defines the interior of the suction funnel, and the insert tapers in a flow direction of air flow from the wide end to the narrow end. Accordingly, a diameter of the interior of the suction funnel adjacent to the narrow end of the insert is substantially larger when compared to the narrow end of the insert.

11 Claims, 3 Drawing Sheets

TWO-STROKE ENGINE AND METHOD FOR OPERATING A TWO-STROKE ENGINE

The present invention relates to a two-stroke engine with external mixture generation in a carburettor, and an associated operating method.

BACKGROUND

Two-stroke engines of conventional construction usually include a so-called crank-chamber scavenging, whereby the sucked-in fuel-air mixture is led first of all into the crank chamber, which receives the crankshaft and is surrounded by the crankcase. There, the fuel-air mixture is supercharged by the piston sliding downwards in the cylinder in the working stroke, and is then transferred, when the piston frees an associated transfer passage in the cylinder wall, to the combustion chamber. In the next stroke, the piston slides upwards and compresses the transferred mixture in the combustion chamber, while at the same time a fresh mixture is sucked into the crank chamber. The terms "up" and "down" refer to an upright cylinder arrangement with the cylinder head located on top.

In a two-stroke spark-ignition engine, ignition of the fuel-air mixture compressed by the piston is effected in the combustion chamber through an active ignition device in the form of a spark plug with associated voltage supply and release electronics, when the piston passes the dead center. The burnt mixture or exhaust gas is released from the combustion chamber at the end of the working stroke through an outlet passage then freed by the piston and is, as a rule, led through an exhaust manifold into the exhaust or muffler section.

Two-stroke engines can be configured for an internal mixture generation with direct injection of the liquid fuel into the combustion chamber or for an external mixture generation in a carburettor. In the carburettor, the liquid fuel is injected into the air flow, which is sucked in or pressed in through a charging device, and atomized. A crank-chamber scavenging is in most cases combined with an external mixture generation.

Usually, a gasoline-oil mixture is supplied as fuel to such two-stroke engines, the addition of oil serving for lubricating the motor. Especially in recent times, it is desired, due to corresponding financial incentives, to replace (regular) gasoline by kerosene, which is normally used as fuel for gas-turbine engines, or also by diesel fuel.

Corresponding attempts to upgrade a two-stroke spark-ignition engine for an operation with diesel or kerosene, are known, for example, from U.S. Pat. No. 5,855,192. For an improved ignition behavior, in particular in the stage of the motor start, a heating of the cylinder head with the help of a glow pencil applied there, which is independent of the spark plug, is provided there. The cylinder head is in this case subjected to a relatively high thermal stress, which generally requires the use of correspondingly high-quality and high-temperature resistant materials and of, for example, ceramic components in the cylinder. Nevertheless, on the whole, the running behavior of motors modified in this manner zierter is not convincing.

SUMMARY

The present invention is, therefore, based on the task to upgrade a two-stroke engine of the above-mentioned type for a supply of kerosene as fuel, by means of as slight and cost-advantageous constructional modifications as possible, without a deterioration of the running behavior and the structural durability. Furthermore, an associated operating method shall be provided.

With regard to the motor, the task is solved according to the present invention by the fact that a suction funnel is arranged upstream of the carburettor on the air-inlet side, an insert being arranged in the area of the inlet port of the suction funnel, said insert tapering first of all continuously in flow direction of the air flow sucked in, in motor operation, and then expanding suddenly.

BRIEF DESCRIPTION OF THE DRAWINGS

An exemplary embodiment of the present invention will be explained in detail in the following by means of a drawing, in which.

Identical parts are marked with the same reference numbers in the three figures.

DETAILED DESCRIPTION

Figure 1:
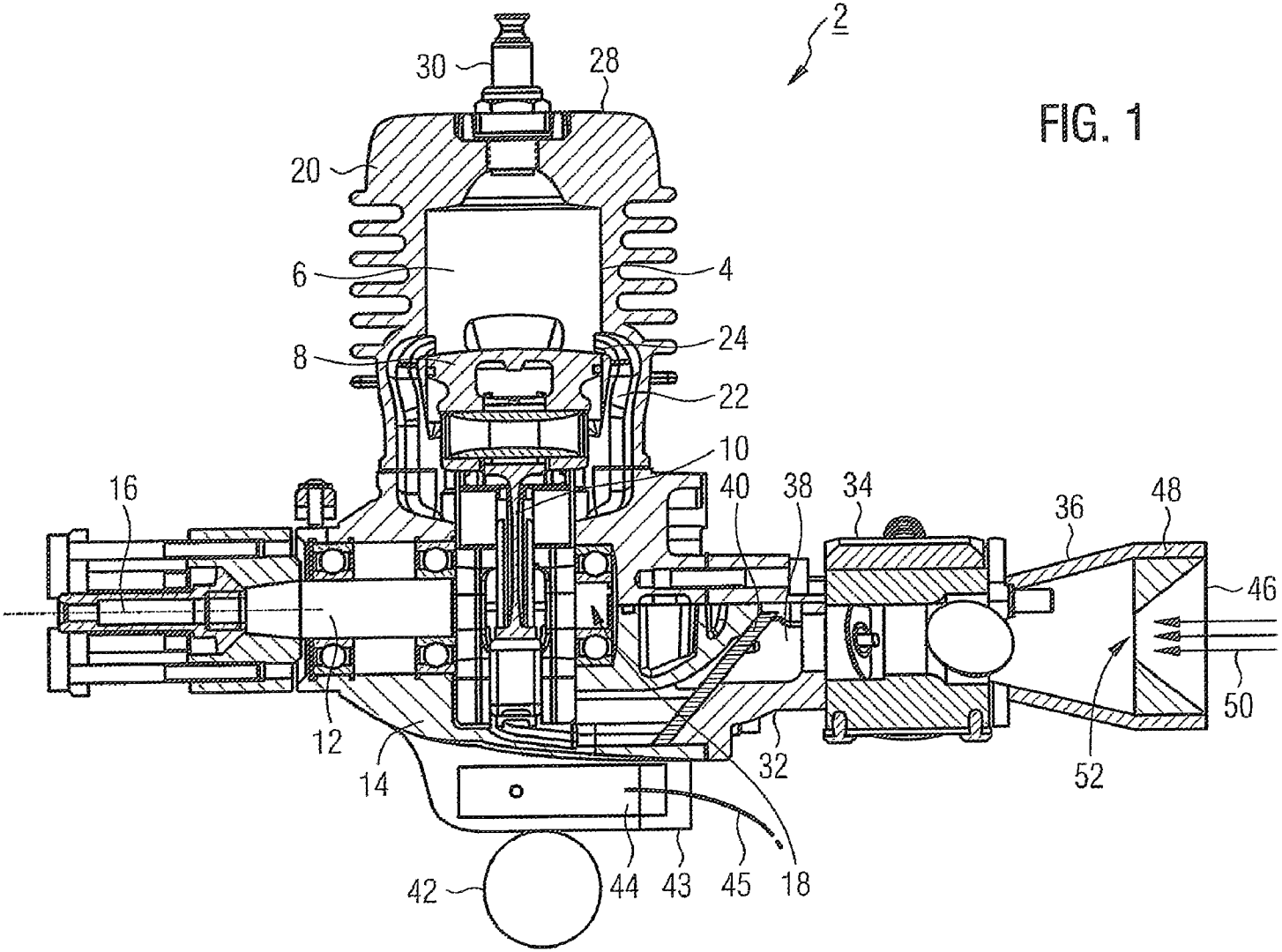
FIG. 1 is a longitudinal sectional view through a two-stroke engine (the crank axis lying in the cutting plane)

The present invention is based on the consideration that the heating of the cylinder head by means of a separate glow pencil or the like, known from the state of the art and taken over by the diesel motor, creates more problems than it offers advantages, so that this concept should be discarded. Surprisingly, it turned out that an ignitable fuel-air mixture can also be provided when using kerosene as fuel, namely by installing an insert of the before-mentioned type in the suction funnel of the carburettor, which generates the eddies in the sucked-in air flow and increases the air flow rate through the carburettor.

In other words: Expediently, a suction funnel tapering towards the carburettor inlet is arranged upstream of the carburettor on the air-inlet side. In the area of the inlet port of the suction funnel, preferably an annular insert is arranged, which first of all tapers in flow direction of the air flow sucked in, in motor operation and then expands suddenly.

The insert can be installed, for example, as a retrofit part in a conventional suction funnel. Alternatively, the suction funnel can also include the desired internal outlining from the start. In particular, a correspondingly modified suction funnel can also be manufactured as a single-piece integral component, for example by a casting method.

Due to the Venturi effect of the narrowing cross-section of the flow passage, the sucked-in air flow is first of all accelerated, i.e. its flow speed is increased. At the transition point, where the cross-section expands suddenly and afterwards continuously narrows again towards the carburettor inlet, in accordance with the specified funnel shape, the air flow is—as a consequence of a speed reduction—strongly swirled. It turned out that such a swirl of the air flow before the entry into the carburettor is advantageous, especially with the atomization of kerosene, and results—in particular in combination with a subsequent preheating of the kerosene-air mixture in the crank chamber (see below)—in an improved combustion.

The carburettor is preferably designed as a diaphragm-type carburettor. This has the advantage that the carburettor will function independently of its position and even under strong vibrations. The fuel-air mist generated in this way is advantageously sucked in through an inlet passage when the piston moves upwards in the crank chamber of the two-stroke engine and is supercharged there, when the piston afterwards moves downwards. Expediently, a non-return valve, designed, for example, as a diaphragm valve, is arranged in the inlet passage situated between the crank chamber and the carburettor, preventing a backflow of the fuel-air mixture from the crank chamber in direction of the carburettor during the downward movement of the piston (supercharging stage).

Furthermore, it has turned out that a particularly good running behavior of a two-stroke engine with crank-chamber scavenging can in particular be achieved if the fuel-air mixture is heated in the crank chamber already before entering the combustion chamber—but after having been atomized in the carburettor—up to an appropriate operating temperature, in particular beyond the temperature achievable by means of supercharging.

For this purpose, a heating of the crankcase over a relatively large surface is provided by means of an associated heating device, which is preferably arranged on the outside of the crankcase facing away from the crank chamber. In this way, it is achieved that during motor operation, heat is transferred from the heated outer wall of the crankcase over the inner wall to the fuel-air mixture coming from the carburettor and flowing into the crank chamber.

The thermal stress of the crankcase keeps in this case within well controllable limits, while consistently avoiding an overstressing—caused, for example, by the use of glow pencils or the like—of the cylinder head, which is anyhow stressed already by the combustion processes in the combustion chamber. Due to the relatively long dwelling time of the fuel-air mixture in the crank chamber, in any case as compared with the dwelling time in the combustion chamber prior to ignition, the heating provided now is extremely efficient. In this case, the fuel-air mixture enters the combustion chamber in preheated condition. The additional heating through the compressing process during the upward movement of the piston need not be so strong any more. In this way, excellent ignition properties are guaranteed, in particular when using kerosene as fuel.

In an embodiment according to the present invention, the heating device is primarily designed as a cold-start aid and includes a number of electric heating elements. For a good heat transfer to the crankcase, these heating elements, which are preferably designed as heating rods or heating mats, advantageously abut directly on the outside of the crankcase, i.e. they are in close thermal contact therewith. Their location on the outside has the advantage that the electric supply lines need not be passed through the crankcase, and that the heating elements are not directly exposed to the chemically aggressive fuel-air mixture. The heating elements are supplied with heating current, above all in case of a cold start of the motor, by an external current source, to warm up the fuel-air mixture in this manner when it flows through the crank chamber. The number of heating elements and their heating power depend in particular on the volume of the crank chamber surrounded by the crankcase and on the warming-up time desired and necessary for reaching of certain temperature level. To make a kerosene-air mixture ignitable for the cold start, the temperature of the crankcase on the inner wall facing towards the mixture should amount, for example, to approximately 80° C. to 90° C.

In an alternative embodiment according to the present invention, the crankcase is advantageously of a double-walled design, the inner and outer walls of the crankcase enclosing a space which can be filled with a liquid. For operating the motor, in particular during the starting process, the space is filled with a liquid, which is then heated by means of a suitable electric heating system, for example, by means of heating rods arranged in the space or outside the outer wall.

To avoid having to operate the electric heating system permanently and to make it possible instead to switch off the motor after the starting process and possibly after a certain minimum running time (warming-up stage) and to disconnect it from the heating-current source, it is advantageously provided to heat the crankcase and thus, the crank chamber, by the hot residues of combustion or exhaust gases liberated during operation. For this purpose, at the combustion-chamber outlet, an exhaust manifold running into a downstream exhaust or muffler system is expediently led around or along the crankcase or possibly also integrated into the crankcase, in such a way that the crankcase is heated by the exhaust manifold through heat radiation and/or through heat conduction. For a close thermal contact, the exhaust manifold advantageously abuts, at least in a partial section, on the outside of the crankcase; preferably, the exhaust manifold is connected there with the crankcase, for example, by welding or brazing. Instead of a substance-locking connection or in addition thereto, a frictional and/or positive-locking connection can, however, also be provided, e.g. by screwing, rivetting, etc.

Alternatively, instead of an exhaust manifold whose end facing away from the combustion-chamber outlet runs into a muffler pot, a muffler itself can be led around the crankcase in the above-described manner.

In an another embodiment according to the present invention, a thermal insulation is provided between the crankcase—which is advantageously heated by a heating device—and the carburettor, so that there is, if possible, no heat transfer or only little heat transfer from the crankcase to the carburettor housing and the carburettor is kept as cool as possible. Expediently, for this purpose, the valve housing located between the crankcase and the carburettor housing and surrounding the inlet passage for the atomized fuel-air mixture with the non-return valve arranged therein, is made of a heat-insulating material with a considerably lower thermal conductivity than the material of the crankcase, in particular of a heat-resistant synthetic material with high mechanical and chemical stress-bearing capacity, e.g. polyphenylene sulfide (PPS) or a similar synthetic material. Furthermore, the exhaust manifold is preferably arranged at a sufficient distance from the valve housing, so that there will be no significant heat transfer through heat radiation.

In an embodiment according to the present invention, the two-stroke engine is designed as a spark-ignition engine, i.e. it includes an electric ignition system with a spark plug integrated in the cylinder head for ignition—controlled independently of the piston position—of the fuel-air mixture compressed by the piston. It would also be imaginable to design the two-stroke engine alternatively as a self-ignition motor with a glow plug permanently glowing in operation, for example with a wire coil coated with platinum iridium.

Regarding the method, the before-mentioned task is solved by atomizing kerosene or diesel fuel in a carburettor and leading the kerosene-air mixture or diesel fuel-air mixture generated in this way into the combustion chamber of the two-stroke engine, an air flow supplied to the carburettor being led, before entering the carburettor, in particular before entering the carburettor, through a section of a flow passage which first of all tapers continuously and then expands suddenly.

By "kerosene", one understands in the present case in particular a fuel made of the light middle distillate of crudeoil refining, namely a light petroleum, otherwise usually applied in aviation for operating gas-turbine engines (aviation turbines). The bubble-point curve of kerosene, which is as a rule widely stretched and flat, lies between the curve of heavy naphta and diesel fuel. Suitable kerosene types are sold, for example, under the trade names JP-1 (Jet Propellant-1) or JET A-1 (former designation: JP-1A) or JP-8 or JET B or TS-1. Kerosene of type JET A-1 is particularly widely used and easy to obtain. For the purpose of lubrication of the motor, a lubricating oil and/or other additives, for example 4% synthetic two-stroke-oil, can be added to the kerosene.

Alternatively to kerosene, a diesel fuel may also be supplied to the two-stroke engine described here.

Preferably, the method is applied in a two-stroke engine with crank-chamber scavenging, the kerosene-air mixture or diesel fuel-air mixture generated in the carburettor being led through the crank chamber into the combustion chamber. Advantageously, the mixture is preheated by means of a heating device when flowing through the crank chamber and ignited by means of an active ignition device after having entered the combustion chamber.

In an embodiment of a method according to the present invention, the crankcase is heated by an electric heating device during a starting process, in particular during a cold start of the motor. After a certain start-up time, advantageously the electric heating device is switched off and the crankcase is heated by an exhaust manifold or muffler, which is connected to the combustion-chamber outlet of the two-stroke engine and through which hot combustion exhaust gases flow, through heat conduction and/or through heat radiation.

Due to the before-described measures, the kerosene-driven two-stroke engine shows a similarly good and "smooth" running as a two-stroke gasoline engine. The better combustion makes the motor run more coolly, fuel consumption is reduced. The mean temperature in the area of the cylinder-head housing will then amount, for example, to only approximately 160° C. to 190° C., as compared with approx. 220° C. of a convention gasoline engine with the same volumetric displacement. It is not necessary either to choose a higher compression ratio than that of gasoline engines. The compression ratio, i.e. the ratio between the total space of the combustion chamber prior to compression and the remaining space after compression can, on the contrary, be somewhat smaller, thanks to the described measures, than that of a gasoline-driven motor, amounting, for example, to only 8:1 to 10:1. This results in a reduction of the vibration level and thus in a longer lifetime of the crankshaft and the associated ball bearings or needle bearings.

The constructional modifications typically necessary for kerosene operation do not affect the motor section properly speaking—cylinder, piston, crankcase—or affect them to an insignificant degree only. Rather are they limited predominantly to peripheral components—exhaust manifold, valve housing, carburettor, and suction funnel. Therefore, they can be retrofitted relatively easily even in existing motors of conventional design.

Figure 2:
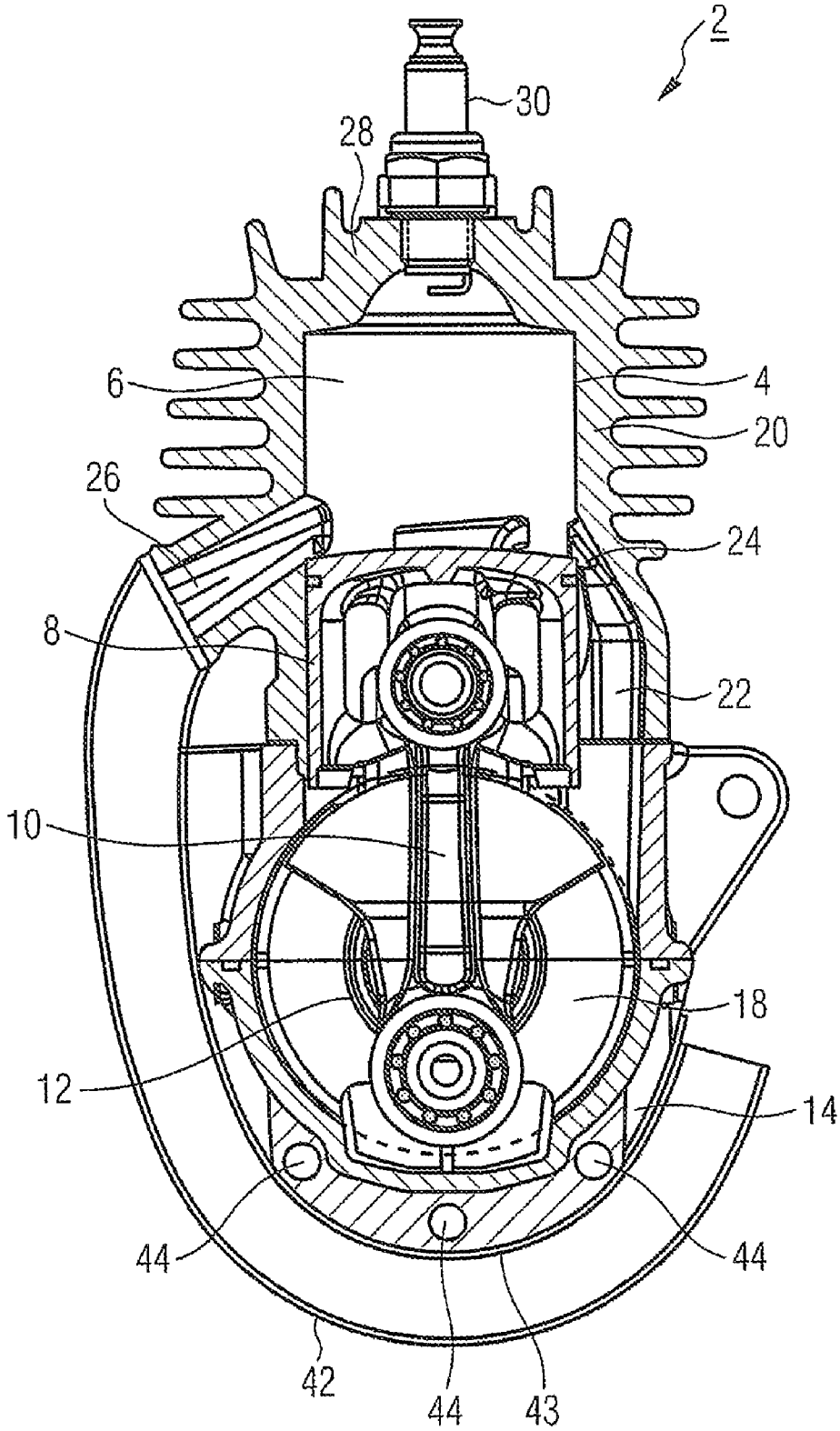
FIG. 2 is a cross-sectional view through the two-stroke engine according to FIG. 1 (the crank axis being normal to the cutting plane)

The two-stroke engine 2 represented in FIG. 1 and FIG. 2 is of a predominantly conventional design and serves, for example, for driving model airplanes or also chain saws, lawn mowers, etc. With a corresponding volumetric displacement, it could, however, also be provided, for example, for driving a passenger aircraft or a passenger car or a motorcycle or the like.

The two-stroke engine 2 includes a piston 8 sliding in a cylinder 4 and driven by periodical combustion processes in the combustion chamber 6. A connecting rod 10 transmits the linear motion of the piston 8 to the crankshaft 12 and transforms it into a rotary motion. The crankshaft 12 is supported in a crankcase 14 and is continued on the drive side by a drive shaft 16, which can be connected to the drivetrain of an engine to be driven or can be equipped with a propeller. The spatial area closed on top by the piston 8, between the crankshaft 12 and the crankcase 14, is called crank chamber 18. The crank chamber 18 is connected by means of a transfer passage 22, which is externally limited by the cylinder housing 20, with the combustion chamber 6, the transfer port 24 running into the combustion chamber 6 being freed substantially only in the lower dead-center position of the piston 8. In this piston position, the outlet passage 26 connected to the combustion chamber 6 (see FIG. 2) is also freed. In the cylinder head 28, an electric spark plug 30 is arranged.

On the side of the crankcase 14 which faces away from the drive shaft 16, a valve housing 32, a carburettor 34 and a suction funnel 36 are adjacent. Through the suction funnel 36, ambient air is sucked in during motor operation and fed to the carburettor 34. In the carburettor 34, designed as a diaphragm carburettor, liquid fuel fed by a supply line (not shown) is injected into the air flow sucked in, and atomized.

During the suction stage, through the suction effect of the piston 8 sliding upwards, the fuel-air mixture passes through the inlet passage 38 surrounded by the valve housing 32 and enters the crank chamber 18. During the following downward movement of the piston 8, the mixture is supercharged in the crank chamber 18, a non-return valve 40 arranged in the inlet passage 38 and designed as a diaphragm valve preventing a backflow to the carburettor 34. At the end of the compression stage, the fuel-air mixture flows through the transfer passage 22 into the combustion chamber 6, at the same time pressing the residues of combustion (exhaust gases), that have remained from the previous combustion process, through the outlet passage 26 out of the combustion chamber 6. During the following upward movement of the piston 8, the mixture is first of all compressed in the combustion chamber 6 and finally ignited by an ignition spark at the spark plug 30; the working stroke starts (of course, the above-described processes are partially running in parallel).

The two-stroke engine 2 has been upgraded through a number of constructional measures for a kerosene operation:

In particular, the exhaust manifold 42 connected to outlet passage 26 and running at the other end, for example, into the resonance pot of a resonance muffler (not shown) is led in the manner of an arc around the lower part of the motor block. The plane in which the arc lies, is in the exemplary embodiment substantially normal to the crank axis or drive axis (see FIG. 2). A lower partial section of the exhaust manifold 42 abuts on the outer wall 43 of the crankcase 14 and is welded to it there. Therefore, an effective heat transfer takes place during motor operation, from the exhaust manifold 42 heated from inside through the hot exhaust gases to the crankcase 14 and thus finally also to the fuel-air mixture coming from the carburettor 34 and flowing into the crank chamber 18, said mixture being, therefore, preheated.

Figure 3:
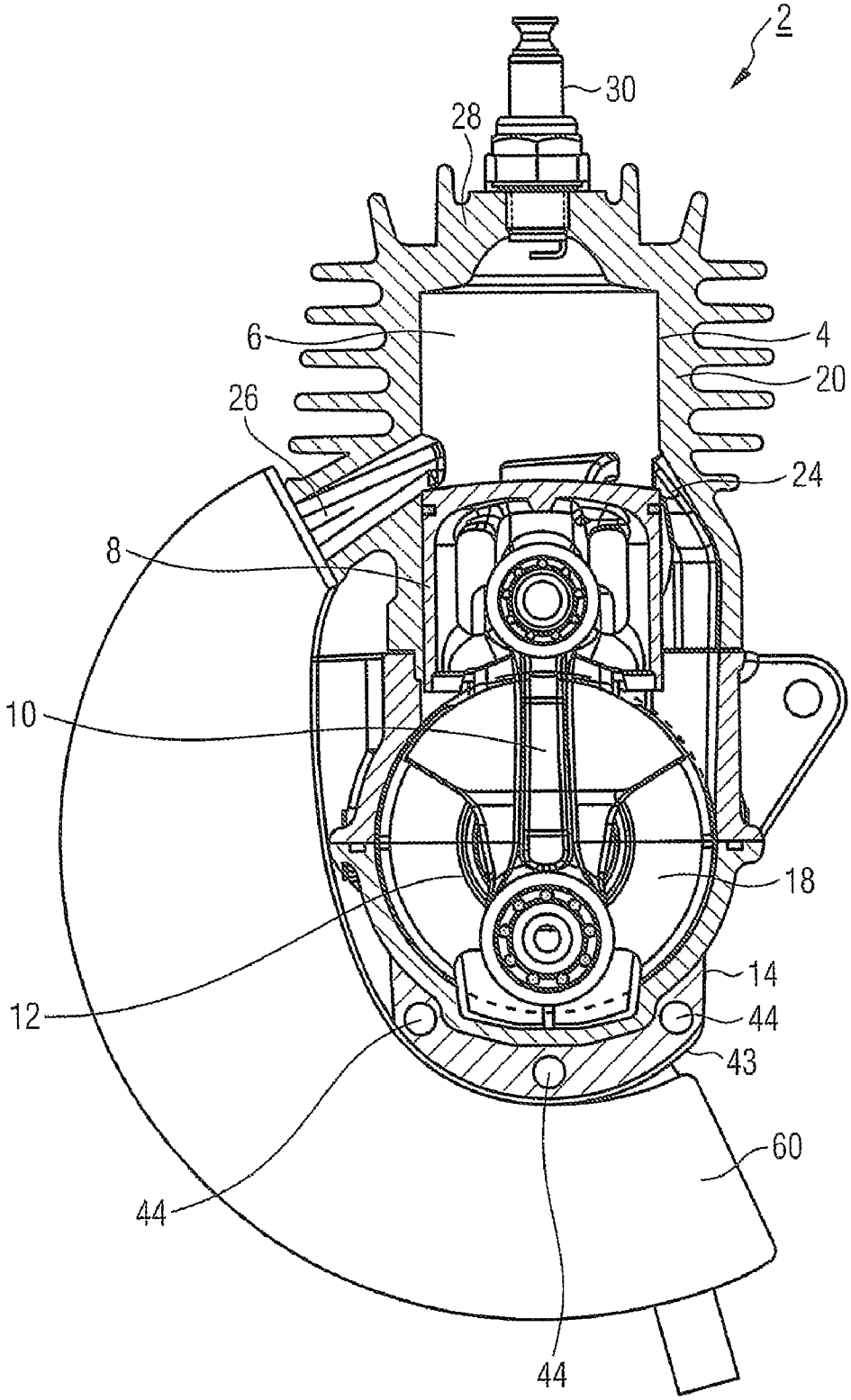
FIG. 3 is a cross-sectional view through an alternative embodiment of a two-stroke engine in accordance with the present invention.

In an alternative variant, shown in FIG. 3, no exhaust-manifold section or only a very short exhaust-manifold section is provided. In this case, the muffler 60 or muffler pot is adjacent to the outlet passage 26 and follows in the manner of an arc the outline of the cylinder 4 and of the crankcase 14, thus obtaining the desired warning-up function.

Furthermore, for a cold start of the motor, an electric heating of the crankcase 14 by means of several electric heating elements 44, here in the form of heating rods, fixed on the outside, possibly inserted in corresponding recesses and abutting on the housing wall, are provided. The electric connection lines 45 of the heating elements 44 can be connected for this purpose to an external heating-current source, not shown here. In an exemplary embodiment, the rod-shaped heating elements 44 are substantially arranged on the underside of the crankcase 14, oriented parallel to the drive shaft 16 and uniformly distributed around the crankcase 14, in order to enable a uniform heating of the interior space, i.e. the crank chamber 18. The concrete execution and arrangement may, however, differ therefrom.

A heating of the cylinder head through additional glow pencils or the like is advantageously not provided. A preheating of the fuel fed to the carburettor 34 is not necessary and advantageously not provided either.

Contrary to the usually metallic crankcase 14 and the also metallic exhaust manifold 42, the valve housing 32 adjacent to the crankcase 14 and connected on the other side with the carburettor housing of the carburettor 34 is made of a material with as low a thermal conductivity as possible, in the present case, e.g., of a heat-resistant, dimensionally stable high-performance plastic, which is resistant to the kerosene-air mixture flowing past it inside. A suitable material is, for example, the glass-fibre reinforced synthetic material based on polyphenylene sulfide, known by the trade name Ryton R-4 (registered trademark of Chevron Phillips Chemical Company LP). Other materials fulfilling the above-mentioned characteristics, can be also used. Expediently, the valve housing 32 is screwed on one side to the crankcase 14 and on the other side, to the carburettor housing.

Finally, the suction funnel 36 arranged upstream of the carburettor 34 on the air suction side has been modified as compared with the variants in use so far, in that an insert 48 narrowing the cross-section and generating eddies is arranged in its wide inlet port 46. Through the annular insert 48, the free cross-section for the flow of the sucked-in air narrows first of all continuously and monotonously in flow direction 50 and then, at the narrowest place, it preferably expands suddenly (discontinuously). Depending on the motor type and the individual case, the diameter of the narrow passage 52 of the insert 48 is preferably 55% to 75%, particularly preferably 60% to 66% of the diameter of the inlet port 48. Viewed in flow direction 50, the diameter suddenly enlarges again, directly behind the narrow passage 52, to almost the value it had in the area of the inlet port 48 (100%) and finally decreases continuously in direction of the carburettor inlet. Such a "funnel-in-funnel" arrangement serves for increasing the pressure of the oxygen share flowing into the carburettor 34, due to the induced eddies, and has turned out to particularly advantageous especially with a kerosene atomization.

In particular when combining the above-described measures, the two-stroke engine is upgraded for an operation with kerosene or also with diesel fuel, without an expensive new construction and new design of the central components cylinder, piston and crankcase or of the ignition system, and that for all usual volumetric displacements of, for example, 30 $cm^3$ or less up to 700 $cm^3$ or more. Of course, the above-described concept can also be realized in multicylinder engines, e.g. in multicylinder straight-type engines, V-type engines, flat engines or radial-type engines. Depending on the position of the outlet passages and depending on the "accessibility" of the crankcase, the course of the exhaust manifold (s) may be varied. Possibly, a single exhaust manifold can then be provided for heating several crankcase sections allocated to the individual cylinders.

The present invention is not limited to embodiments described herein; reference should be had to the appended claims, and such modifications are evident for the person skilled in the art in the light of the above description.

LIST OF REFERENCE NUMBERS

2 Two-stroke engine
4 Cylinder
6 Combustion chamber
8 Piston
10 Connecting rod
12 Crankshaft
14 Crankcase
16 Drive shaft
18 Crank chamber
20 Cylinder housing
22 Transfer passage
24 Transfer port
26 Outlet passage
28 Cylinder head
30 Spark plug
32 Valve housing
34 Carburettor
36 Suction funnel
38 Inlet passage
40 Non-return valve
42 Exhaust manifold
43 Outer wall
44 Heating element
45 Connection line
46 Inlet port
48 Insert
50 Flow direction
52 Narrow passage
60 Muffler

We claim:

1. A two-stroke engine with external fuel mixture generation in a carburettor, comprising:

a suction funnel having an interior disposed upstream of the carburettor;

a tapered insert having a narrow end and a wide end disposed in an area of an inlet port of the suction funnel, wherein the insert tapers in a flow direction of air flow from the wide end to the narrow end, and wherein a diameter of the interior of the suction funnel adjacent to the narrow end of the insert is substantially larger than the narrow end of the insert.

2. The two-stroke engine as recited in claim 1, further comprising:

a crank chamber surrounded by a crankcase;

a heating device configured to heat the crankcase.

3. The two-stroke engine as recited in claim 2, wherein the heating device heats the crankcase from an outer wall.

4. The two-stroke engine as recited in claim 2, wherein the heating device includes a plurality of electric heating elements.

5. The two-stroke engine as recited in claim 4, wherein at least one of the plurality of heating elements abuts the outer wall of the crankcase.

6. The two-stroke engine as recited in claim 2, wherein the crankcase includes a first wall and a second wall forming a double-wall, the first and the second walls of the crankcase forming an enclosed space configured to be filled with a liquid, the liquid heatable using at least one of the plurality of heating elements.

7. The two-stroke engine as recited in claim 2, wherein the heating device includes at least one of an exhaust manifold and a muffler disposed along the crankcase and abutting thereon.

8. The two-stroke engine as recited in claim 7, wherein the at least one of the exhaust manifold and the muffler is connected to the crankcase.

9. The two-stroke engine as recited in claim 1, further comprising:

a motor unit including a cylinder housing and a crankcase;

a thermal insulation disposed between the motor unit and the carburettor.

10. The two-stroke engine as recited in claim 9, further comprising a valve housing made of a heat-resistant synthetic material disposed between the crankcase and the carburettor.

11. The two-stroke engine as recited in claim 1, wherein the engine is a spark-ignition engine having an active ignition device.

* * * * *